US012729587B1

(12) United States Patent
Coniglio

(10) Patent No.: US 12,729,587 B1
(45) Date of Patent: Sep. 8, 2026

(54) PORTABLE DRILL FOR MULTIDIRECTIONAL UNDERGROUND DRILLING

(71) Applicant: John A. Coniglio, Stuart, FL (US)

(72) Inventor: John A. Coniglio, Stuart, FL (US)

( * ) Notice: Subject to any disclaimer, the term of this patent is extended or adjusted under 35 U.S.C. 154(b) by 0 days.

(21) Appl. No.: 19/276,925

(22) Filed: Jul. 22, 2025

(51) Int. Cl.
*E21B 7/06* (2006.01)
*E21B 7/04* (2006.01)

(52) U.S. Cl.
CPC . *E21B 7/06* (2013.01); *E21B 7/04* (2013.01)

(58) Field of Classification Search
CPC ..... E21B 7/04; E21B 7/06
See application file for complete search history.

(56) References Cited

U.S. PATENT DOCUMENTS 4,417,628 A * 11/1983 Gessner ..... E02F 5/18 173/159
7,748,471 B2 * 7/2010 Osadchuk ..... E21B 7/02 173/28
9,556,691 B2 1/2017 Van Zee et al.
9,598,905 B2 3/2017 Van Zee et al.
11,149,501 B2 10/2021 Smith et al.
11,708,724 B2 7/2023 Metcalf
2009/0095526 A1 4/2009 Lane et al.
2020/0392798 A1 * 12/2020 Cutler ..... E21B 3/02
2021/0189802 A1 6/2021 Langenfeld et al.

* cited by examiner

*Primary Examiner* — D. Andrews

(74) *Attorney, Agent, or Firm* — Connelly Law PLLC; William Connelly, III

(57) ABSTRACT

A portable, attachable drill for multidirectional underground drilling is disclosed. The drill includes jack assembly for adjusting the drill angle and an attachment for portability and placement of the drill. The drill further comprises a body, a track assembly mounted on the body and a carriage assembly slidably mounted on the track assembly to rotate and move the drill pipe along the track assembly. The drill pipe is rotated by a gearbox assembly attachably detached to the carriage assembly with the gearbox assembly spring loaded to the carriage assembly for ease of removal.

14 Claims, 11 Drawing Sheets

PORTABLE DRILL FOR MULTIDIRECTIONAL UNDERGROUND DRILLING

FIELD OF THE INVENTION

The invention generally relates to a portable, attachable drill for multidirectional underground drilling. More particularly, the invention relates to a portable drill that can be easily moved and adjusted for multidirectional drilling operations.

BACKGROUND

Various drilling mechanisms are known for traditional horizontal drilling or boring into a surface. In addition to being quite large and requiring large transport means, horizontal directional drills are often used for the installation of conduits such as fiber optic lines, water sewer, or gas lines. Traditional horizontal drilling also enables installation of conduits under obstructions such as roads, buildings, or river crossings, while, at the same time, avoiding underground utilities. Generally, a traditional horizontal drill machine is transported to a specific location, unloaded, and set up in the specific direction one intends to drill. Essentially, a traditional horizontal drill operates through the use of hydraulics wherein a drill pipe is spun and pushed into the ground. When the drill pipe is almost completely used or pushed underground, another drill pipe is then attached or threaded to continue the boring process. Further, drilling fluid commonly called "mud" or "slurry" may be pumped to the cutting head or drill bit to facilitate efficient cutting and cleaning of the borehole. Therefore, boreholes of any desired length can be drilled using horizontal directional drills. However, the conventional horizontal drills are often quite large, have a large footprint, and can be difficult to manipulate in tight areas or smaller jobs sites. Moreover, the size of such drills can make transport difficult.

Typically, conventional horizontal directional drills are operable to drill in a single direction, usually away from a user. In addition, once a conventional horizontal drill is set in place there is either very limited or no mechanism to adjust the height or angle of the drill pipe. Moreover, mechanisms within conventional horizontal drills are difficult to service requiring considerable time and effort to remove, replace and service. Therefore, it would be advantageous to have a more portable drill that is easy to transport, position, service, and is adjustable based on a desired height or angle.

SUMMARY

An object of the invention is to provide a more portable drill for the multidirectional drilling of pipes into a surface.

According to an embodiment of the invention, a more portable, attachable drill, also referred to as "the drill", for multidirectional drilling of pipes into a surface is disclosed. The drill includes a body and a track assembly mounted on the body. The drill further includes a carriage assembly slidably mounted on the track assembly to move the pipe along the track assembly. The drilling pipe is rotated by a gearbox assembly coupled to the carriage assembly.

According to another embodiment of the invention, the drill includes a body and a hydraulic jack assembly coupled at a first end of the body. The hydraulic jack assembly is configured to adjust the height and angle of the drill. Further, the drill includes a track assembly mounted on top of the body. The track assembly includes a track plate and a guide rail mounted on the track plate. The track plate further comprises a flat side and a notched side. The drill further includes a carriage assembly slidably mounted on the track assembly to move the pipe along the track assembly. Furthermore, the drill includes a gearbox assembly coupled to the carriage assembly to rotate the drilling pipe.

According to another embodiment of the invention, the drill includes a body and a track assembly mounted on top of the body. Further, the drill includes a carriage assembly slidably mounted on the track assembly to move the pipe along the track assembly. The drill further includes a gearbox assembly coupled to the carriage assembly to rotate the drilling pipe and a pair of spring slide assemblies configured to couple the carriage assembly and the gearbox assembly. Each of the pair of spring slide assemblies include a carriage mount part coupled to the carriage assembly, a gearbox mount part coupled to the gearbox assembly, and a shaft passing through the carriage mount part and gearbox mount part, and a spring mechanism at each end of the shaft. The gearbox mount part slides along the shaft with respect to the carriage mount part during the operation of the drill.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

Figure 1A:
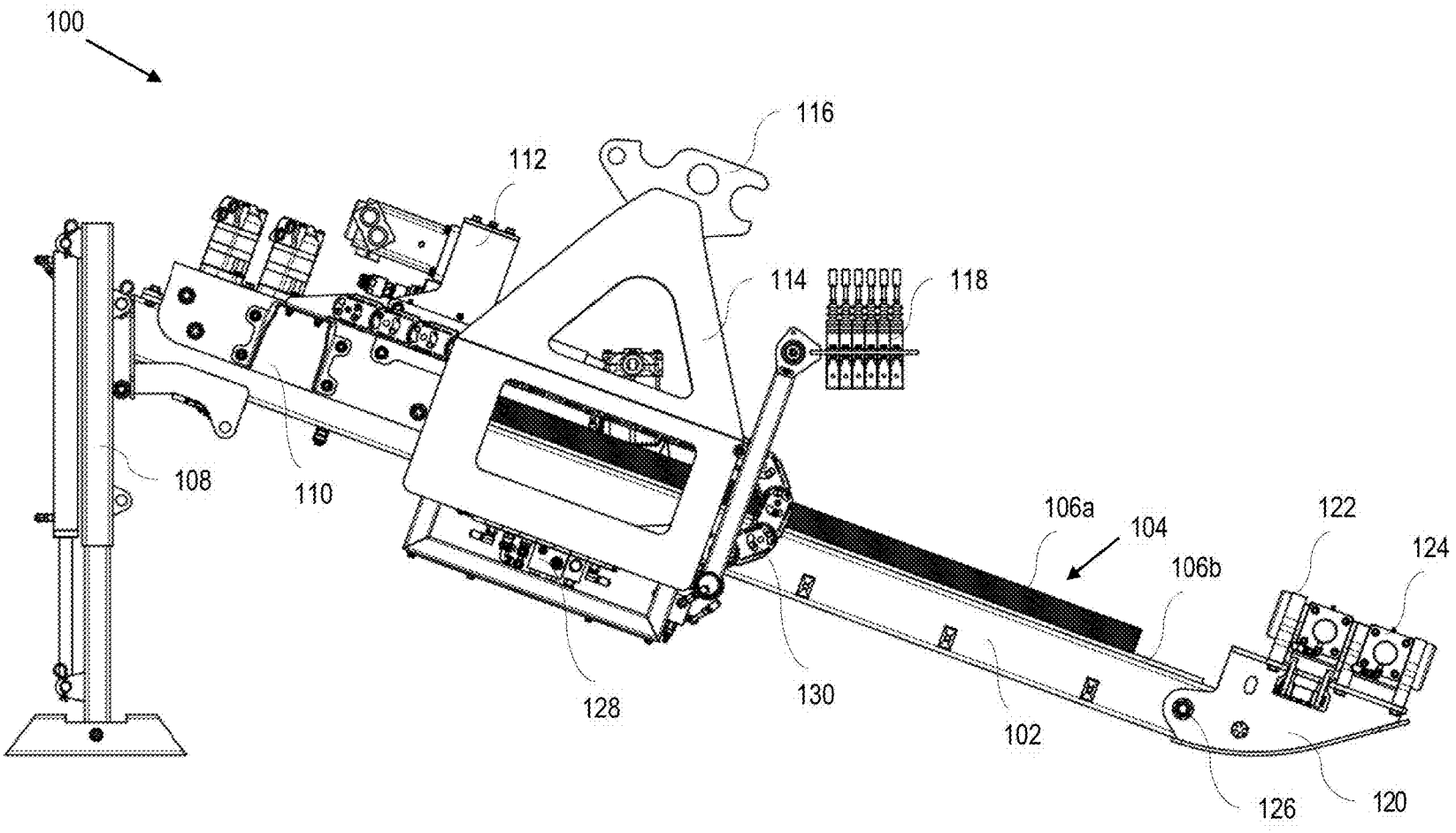
FIG. 1A is a side view of a drill, according to an embodiment of the present invention.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in this specification do not necessarily all refer to the same embodiment. Furthermore, the particular features, structures, or characteristics may be combined in any suitable manner in one or more embodiments.

Figure 1B:
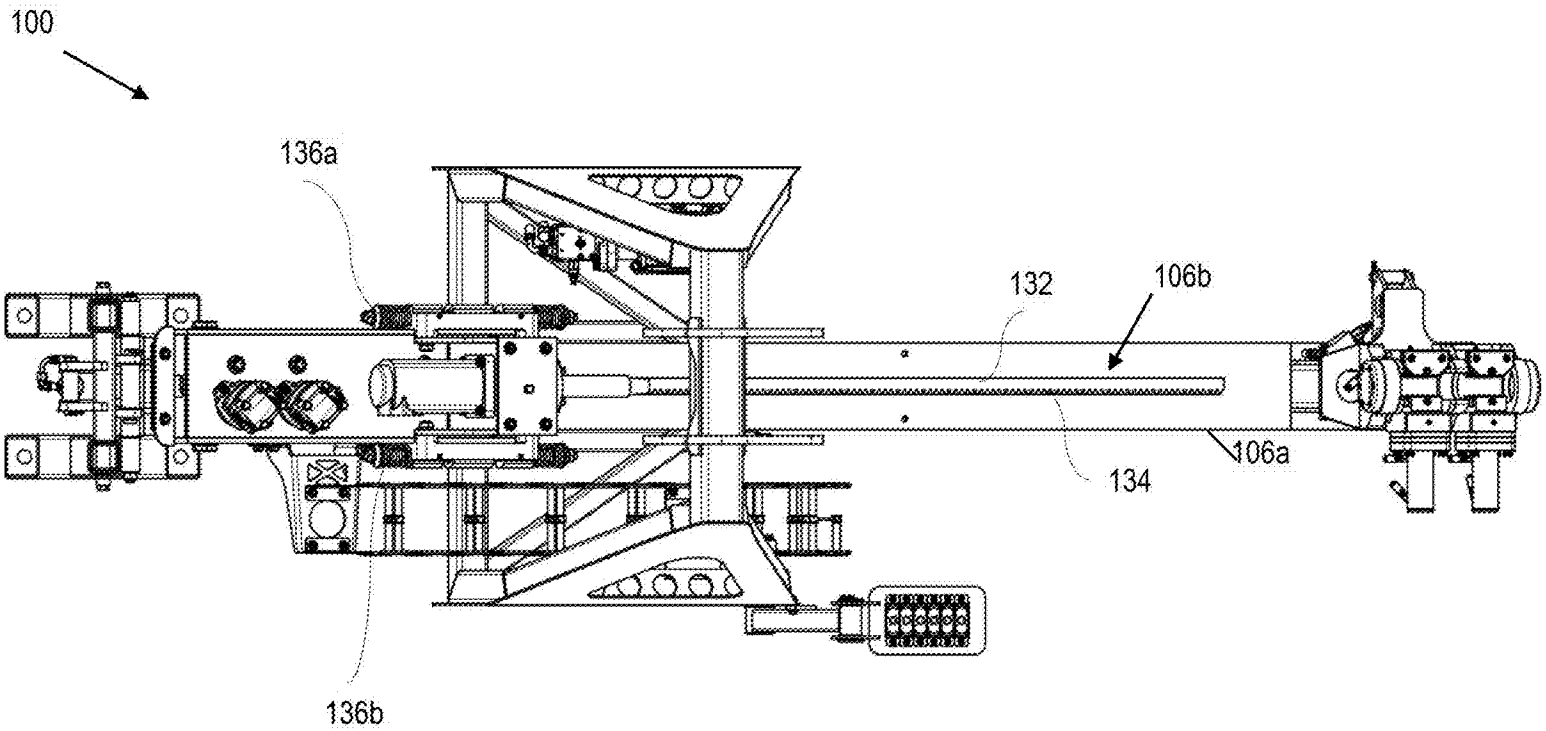
FIG. 1B is a top view of the drill as shown in FIG. 1A, according to an embodiment of the present invention.

FIG. 1A is a side view of the drill 100, according to an embodiment of the present invention. The drill 100 can enable driving of drill pipes (not shown) into a drilling surface such as under roads, buildings, or river crossings, and the like. In an embodiment of the present invention, the drill 100 can be a multidirectional directional drill. As shown, the drill 100 may include a body 102 that is coupled to a hydraulic jack assembly 108 at one end, and a wrench assembly 120 at another end. Further, the body 102 may include a track assembly 104 coupled to the top of the body 102. The track assembly 104 may include a guide rail 106*a* and a track plate 106*b*. In an embodiment of the present invention, the drill 100 may include a carriage assembly 110 mounted on top of the track assembly 104. The carriage assembly 110 can slide along a guide rail 106*a* of the track assembly 104 for driving the drill pipe into and/or out of the wrench assembly 120. As shown in FIG. 1B, the track plate 106*b* may include a flat side 132 and a notched side 134.

The carriage assembly 110 may include drive gears (not shown) that engage with the notched side 134 of the track plate 106*b* (shown in FIG. 1B) to move the carriage assembly 110 along the guide rail 106*a* of the track assembly 104. Further, the drill 100 may include a gearbox assembly 112 that rotates and controls the rotational speed of a drill pipe during the drilling operation. Therefore, the back-and-forth motion of the carriage assembly 110 and the rotational motion provided by the gearbox assembly 112 can drive the drill pipe into the drilling surface. The components and operations of the carriage assembly 110 and the gearbox assembly 112 are explained in detail in conjunction with FIGS. 4A-4B.

Figure 1C:
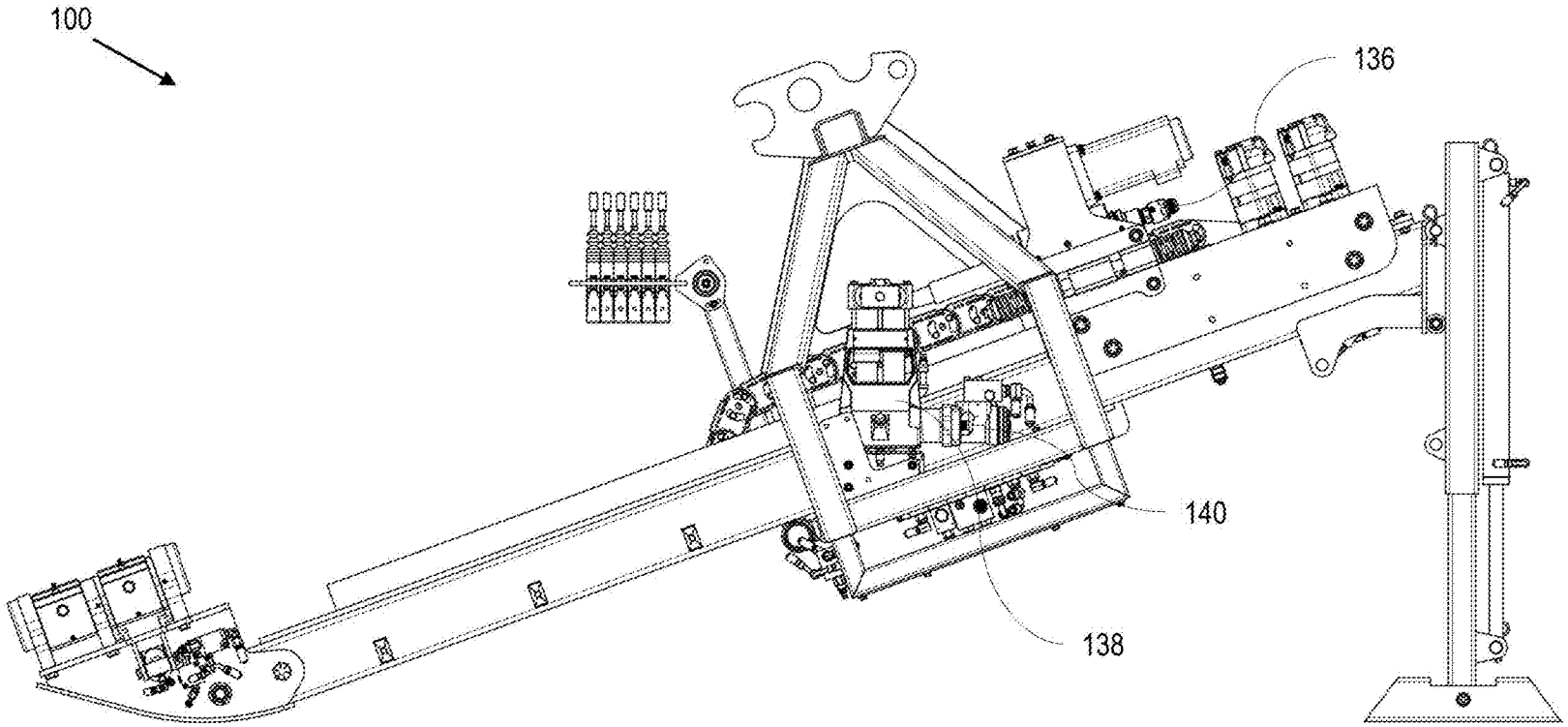
FIG. 1C is a another side view of the drill as shown in FIG. 1A, according to an embodiment of the present invention.

FIG. 1C is another side view of the drill as shown in FIG. 1A, according to an embodiment of the present invention. As shown, the drill 100 may include a mud pump 138 actuated by a hydraulic motor 140 to pump drilling fluid or mud required for the drilling operation. The drilling fluid can be supplied along the drill pipes through a mud inlet 136 for providing lubrication and efficient cutting and cleaning of the borehole. In an embodiment of the present invention, the mud inlet 136 can be located near the gearbox assembly 112.

Referring back to FIG. 1A, the hydraulic jack assembly 108 may provide stability to the drill 100, in an embodiment of the present invention. Further, the hydraulic jack assembly 108 may enable adjustment of the height and angle of the drill 100. The operation of the hydraulic jack assembly 108 is explained in conjunction with FIGS. 3A-3D.

Further, as shown in FIG. 1A, the wrench assembly 120 can be coupled to the body 102 through couplings 126, such as, but not limited to, bolts or screws. The couplings 126 may enable replacement or removal of the wrench assembly 120 for ease of service and maintenance. The wrench assembly 120 may include guide bushings 122 for guiding drill pipes into and/or out of hydraulic wrenches 124. In an embodiment of the present invention, the hydraulic wrenches 124 may enable attachment and/or removal of drill pipes during the operation of the drill 100. In an embodiment of the present invention, the wrench assembly 120 may include various components such as, but not limited to, clamps, hydraulic cylinders (not shown), or other components for the desired operation.

Further, the body 102 may include hydraulic joysticks 118 and control valves 128 for controlling the operations of the drill. For example, the control valves 128 may control various hydraulic motors provided on the drill 100. In an embodiment of the present invention, the control values 128 can be placed under the body 102 to prevent any damage. Further, a hose raceway 130 on the body 102 may provide a cover to hydraulic lines (not shown) running from the control values 128 to various hydraulic motors on the drill 100. Further, the body 102 may include an attachment frame 114 coupled to an attachment bracket 116. In an embodiment of the present invention, the attachment frame 114 can be made of triangulated tube and plate steel frame for strength and durability. In other embodiments of the present invention, the attachment frame 114 may comprise any configuration, as well as, any other material to provide strength and durability. The attachment bracket 116 can provide an attachment means which may include one or more brackets that enable the attachment of the drill 100 to an external device or external hydraulic arm.

Figure 2:
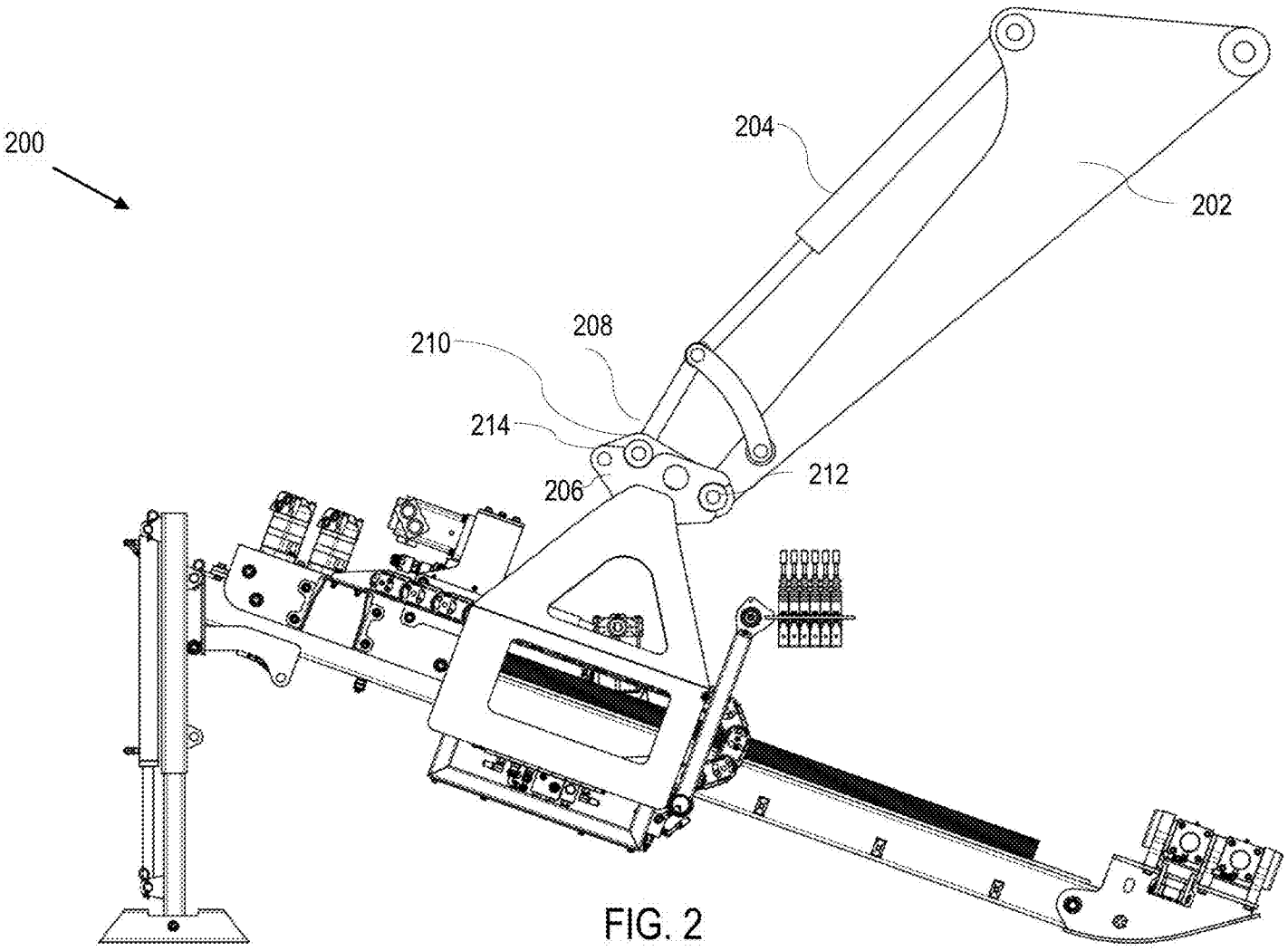
FIG. 2 is side view of the drill connected to an external device, according to an embodiment of the present invention.

FIG. 2 is a side view of the drill 200 connected to an external device 202 in the form of a hydraulic excavator arm of a backhoe, according to an embodiment of the present invention. In an embodiment of the present invention, the external device 202 may include, but not limited to, any hydraulic connection for lifting and placing the drill 200 in a desired area and direction for drilling. As shown, the external device 202 can attach to the attachment bracket 206 of the drill 200. The external device 202 may include an attachment end 208 that attaches to the attachment bracket 206 through attachment points 210 and 212. Further, the attachment end 208 can be locked to the attachment bracket 206 at the lock point 214 through any positive fit mechanism, such as but not limited to, a lock pin, a bolt, a screw or the like. The external device 202 may further include a hydraulic arm 204 that may be actuated by the external hydraulic device 202 to carry, adjust, or orient the drill 200. Therefore, the drill 200 may be connected to an external device 202 as desired based on the requirements of the drilling operation.

Figure 3A:
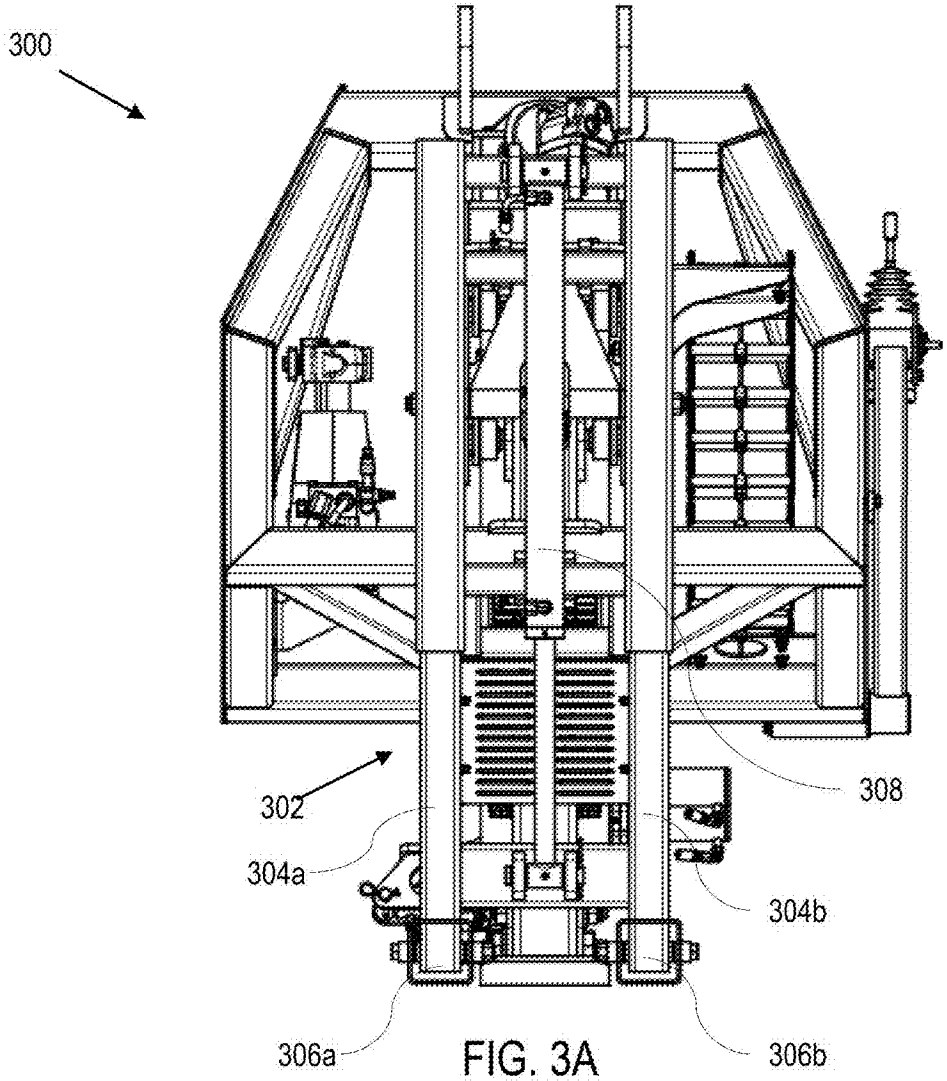
FIG. 3A is a rear view of the drill, according to an embodiment of the present invention.

FIG. 3A is a back view of the drill 300 as previously shown in FIG. 1A, according to an embodiment of the present invention. As shown, the hydraulic jack assembly 302 may include telescopic legs 304*a* and 304*b* supported on support foots 306*a* and 306*b* respectively. Further, the hydraulic jack assembly 302 may include a hydraulic arm 308 that is powered hydraulically to actuate the telescopic legs 304*a-b* for adjusting the height of the drill 300. One of ordinary skill in the art will appreciate that while only a single hydraulic arm is shown, multiple arms may be used to achieve the desired height adjustment. In an embodiment of the present invention, the hydraulic arm 308 can be powered by a hydraulic motor (not shown) available on the drill 300.

Figure 3B:
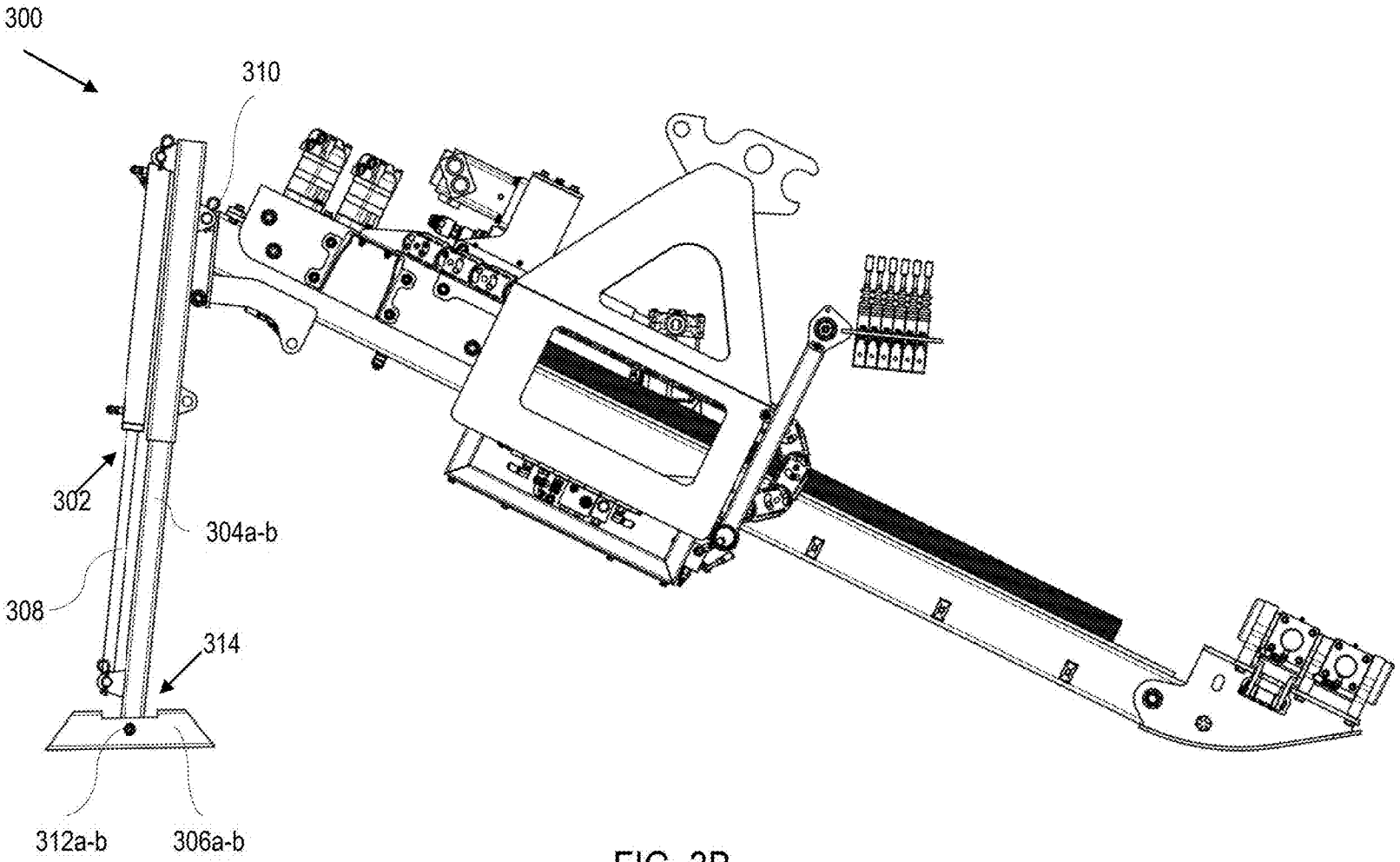
FIG. 3B is a side view of the drill in a fully elevated position, according to an embodiment of the present invention.

FIG. 3B is a side view of the drill 300 in a fully elevated position, according to an embodiment of the present invention. In a fully elevated position, the hydraulic arm 308 is fully extended. In an embodiment of the present invention, the hydraulic jack assembly 302 can be coupled to the body 102 shown in FIG. 1A through a lock pin arrangement 310. As shown, the hydraulic jack assembly 302 is coupled to the body 102 shown in FIG. 1A through a lock pin 310.

Figure 3C:
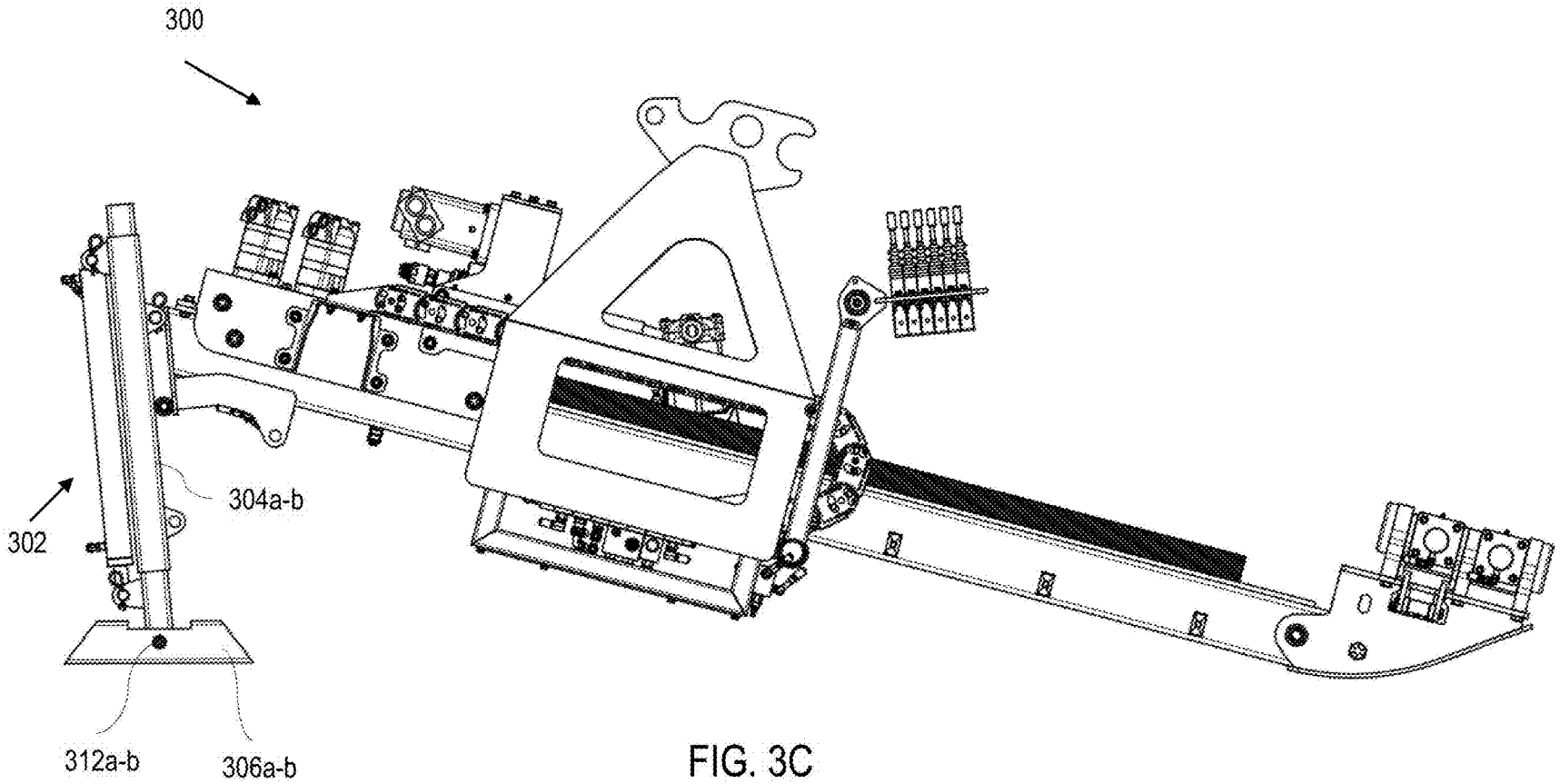
FIG. 3C is a side view of the drill in an intermediate elevated position, according to an embodiment of the present invention.

Further, as shown in FIG. 3C the drill 300 may be retracted from the fully elevated position to a lower height with respect to the drilling surface. In an embodiment of the present invention, the telescopic legs 304*a-b* can be rotatably hinged 312*a-b* at the support foots 306*a-b*. Therefore, the telescopic legs 304*a-b* may be tilted or oriented at an angle 314, shown in FIG. 3B. with respect to the foots 306*a-b*. As a result, both the height and angle of the drill 300 may be adjusted for the drilling operation.

Figure 3D:
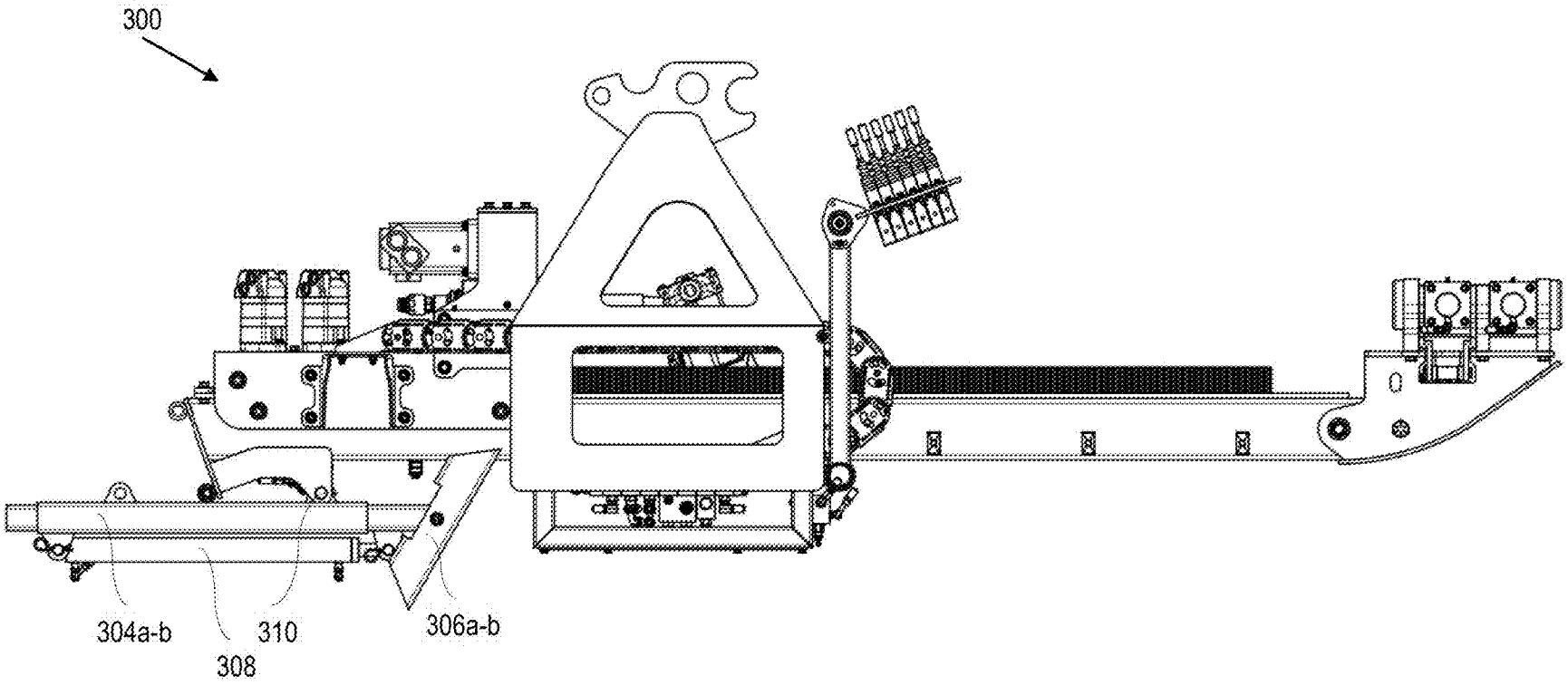
FIG. 3D is a side view of the drill in a collapsed position, according to an embodiment of the present invention.

FIG. 3D is a side view of the drill 300 in a collapsed position, according to an embodiment of the present invention. In an embodiment of the present invention, the lock pin 310 can be removed and the hydraulic jack assembly 302 may be attached to the lock pin 310 in the collapsed position. The collapsed position of the hydraulic jack assembly 302 enables efficient storage and transport of the drill 300 as less space is required. One of ordinary skill in the art will appreciate that the coupling mechanism of the hydraulic jack assembly 302 as shown in FIG. 3B is not limited to the lock ping arrangement, and any other known in the art mechanism may also be used.

Figure 4A:
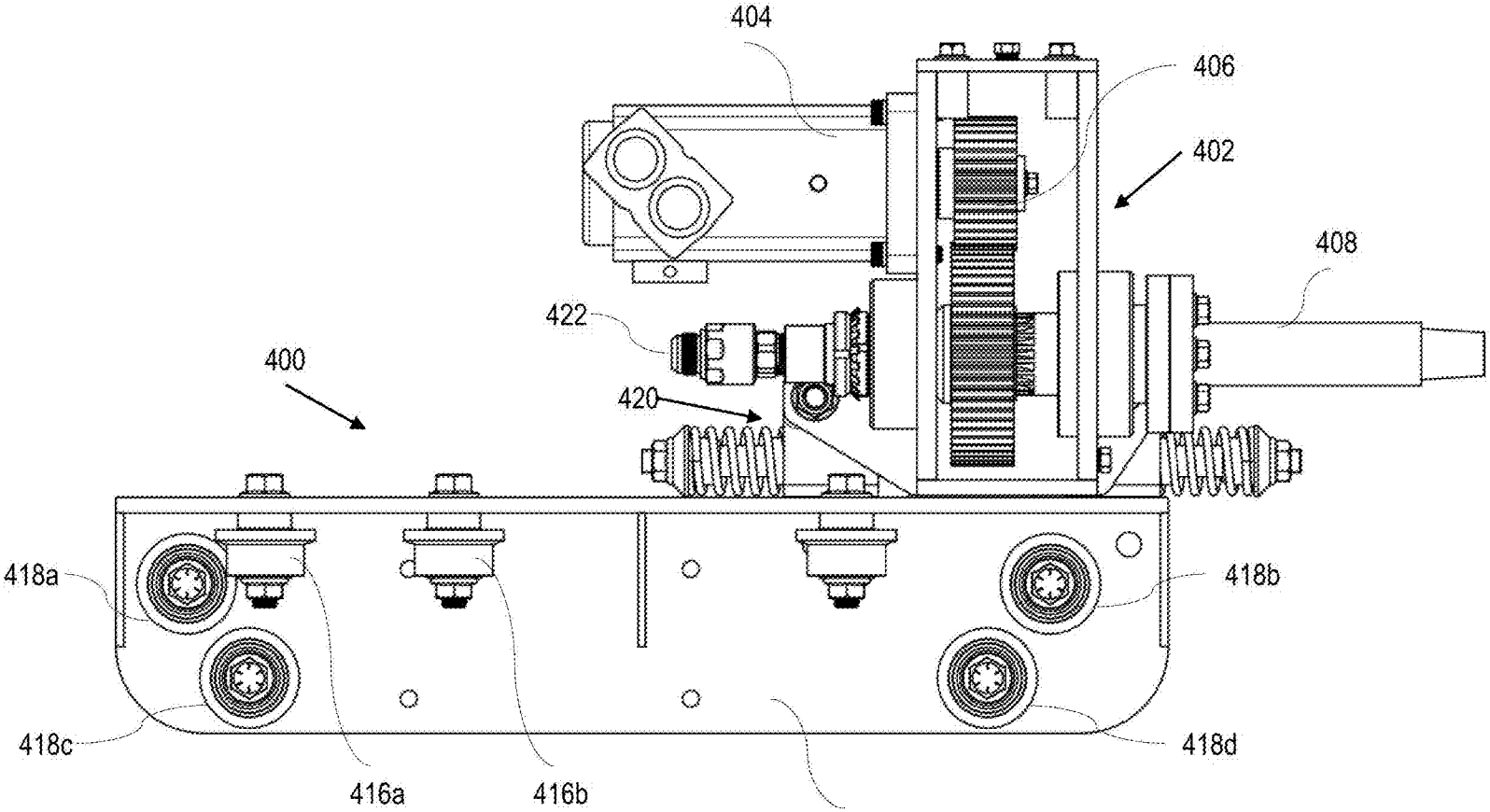
FIG. 4A is a side view of a carriage assembly of the drill, according to an embodiment of the present invention.

FIG. 4A is a side view of the carriage assembly 400, according to an embodiment of the present invention. As discussed above, the carriage assembly 400 can be mounted on top of the track assembly 104 (shown in FIG. 1A) that slides along the guide rail 106*a* (shown in FIG. 1B) for providing torque and force to drive the drill pipe and facilitate the drilling operation. Further, the gearbox assembly 402 can be mounted on top of a carriage body of the carriage assembly 424. The gearbox assembly 402 may include a hydraulic powered spindle motor 404 that powers a drive gear arrangement 406 to rotate a spindle 408. The spindle 408 may rotate the drill pipe mounted on the spindle 408 for the drilling operation. In an embodiment of the present invention, the gearbox assembly 402 may provide a gear reduction for the required torque and rotational speed of the spindle 408.

Figure 4B:
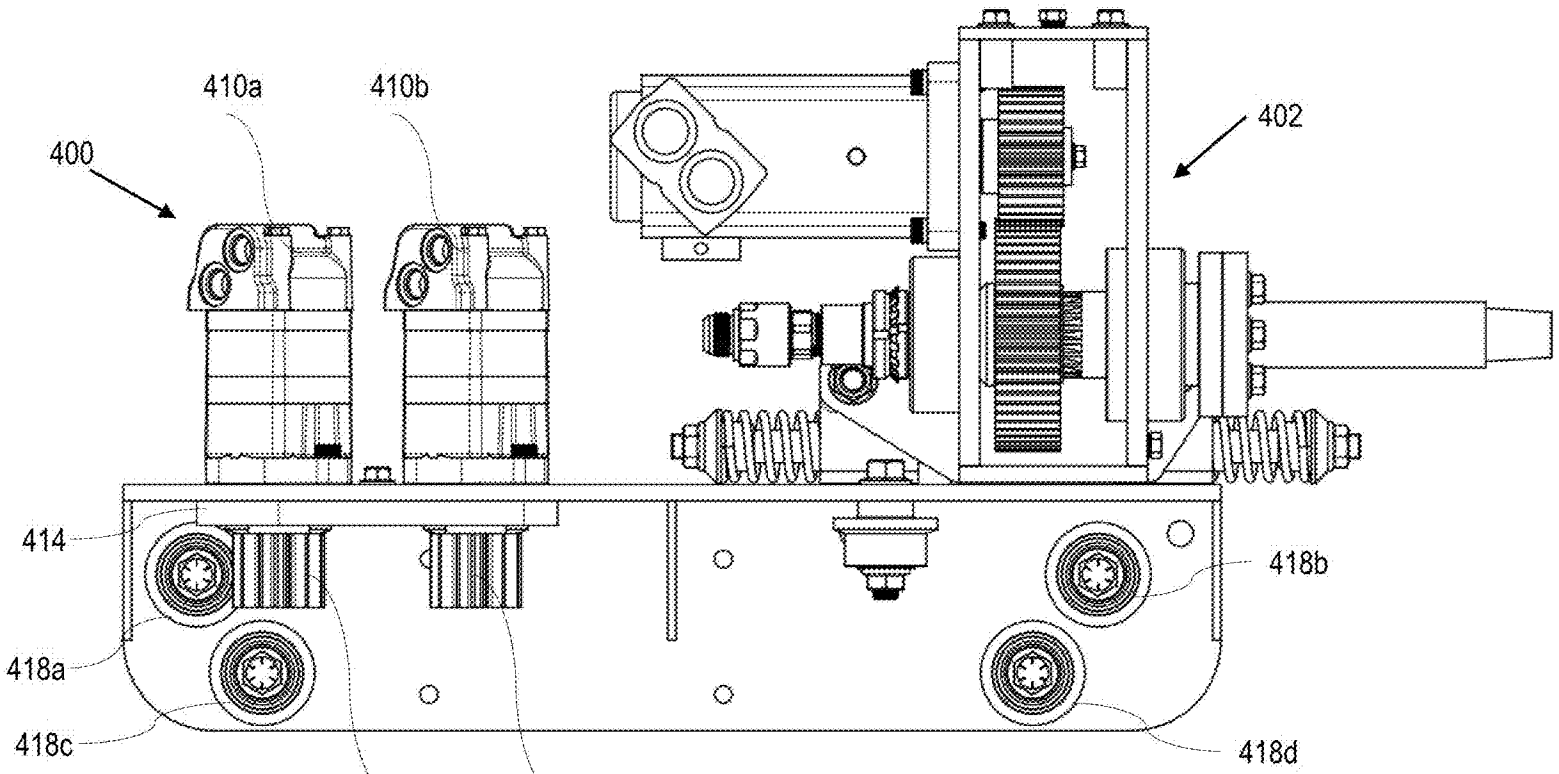
FIG. 4B is a side view of the carriage assembly mounted with thrust motors, according to an embodiment of the present invention.

FIG. 4B is a side view of the carriage assembly 400 with hydraulic thrust motors 410*a-b*, according to an embodiment of the present invention. The hydraulic thrust motors 410*a-b* may actuate thrust drive gears 412*a-b* that engage with the notched side 134 of the track plate 106*b* shown in FIG. 1B. Further, the hydraulic thrust motors 410*a-b* can be mounted on the carriage assembly 400 through a mount plate 414. In an embodiment of the present invention, the mount plate 414 can be a bolt mounted plate that protects the threads on the notched side 134 of the track plate 106*b* shown in FIG. 1B from wear and tear during the drilling operation.

Referring back to FIG. 4A, the carriage assembly 400 may include track rollers 416*a* and 416*b* that ride along the flat side 132 of the track plate 106*b* shown in FIG. 1B. Therefore, the thrust drive gears 412*a-b* (shown n FIG. 4B) may move the carriage assembly 400 back and forth on the guide rail 106*a*, and the track rollers 416*a-b* control the thrust forces from the thrust drive gears 412*a-b* to enable stable movement of the carriage assembly 400 along the track assembly 104 shown in FIG. 1A. In an embodiment of the present invention, the track rollers 416*a-b* can be sealed bearing track rollers and are replaceable. Further, the carriage assembly 400 may include edge track rollers 418*a-d* that guide the carriage assembly 400 along the track assembly 104. The edge track rollers 418*a* and 418*b* may capture a top surface of the track plate 106*b* and the edge track rollers 418*c* and 418*d* capture a bottom surface of the track plate 106*b*. Therefore, the edge track rollers 418*a-d* can control any play or slack during the movement of the carriage assembly 400. In an embodiment of the present invention, the edge track rollers 418*a-d* can be sealed bearing track rollers and are replaceable.

In an embodiment of the present invention, the gearbox assembly 402 can be coupled to the carriage body of the carriage assembly 424 by a pair of spring slide assemblies 420 (136*a* and 136*b* as shown in the FIG. 1B). More specifically, as depicted in FIG. 1, the spring slide assembly 136*a* can couple one side of the carriage assembly 110 with the gearbox assembly 112, and the spring slide assembly 136*b* can couple the other side of the carriage assembly 110 with the gearbox assembly 112.

Figure 5A:
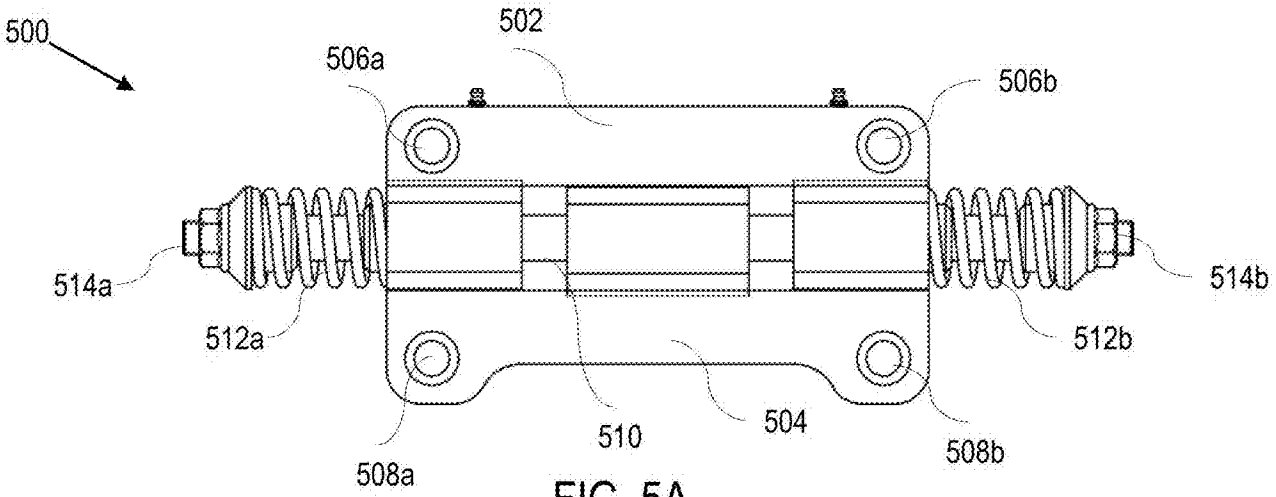
FIG. 5A is a side view of a spring slide assembly of the drill, according to an embodiment of the present invention.
Figure 5B:
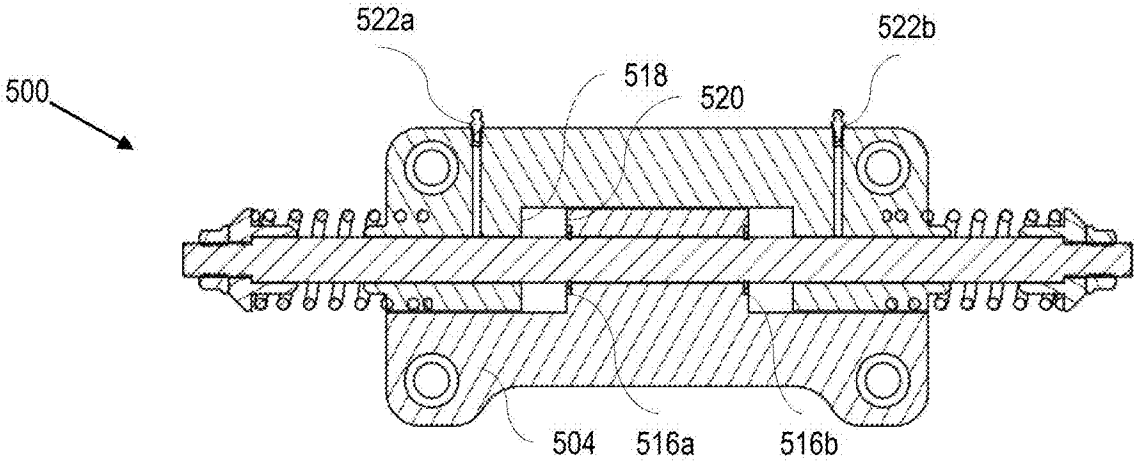
FIG. 5B is a sectional view of the spring slide assembly shown in FIG. 5A, according to an embodiment of the present invention.

FIG. 5A is a side view of the spring slide assembly 500 and FIG. 5B is a sectional view of the spring slide assembly 500, according to embodiments of the present invention. The spring slide assembly 500 may include a gearbox mount part 502 and a carriage mount part 504. The gearbox mount part 502 can couple the spring slide assembly 500 to the gearbox assembly 112 depicted in FIG. 1 at coupling points 506*a-b*. The carriage mount part 504 can couple the spring slide assembly 500 to the carriage assembly 110 in FIG. 1 at coupling points 508*a-b*. In an embodiment of the present invention, coupling can be achieved by using a mechanism that provides an ease of replacement, attachment, and detachment. For example, the coupling can be performed by using removable and replaceable bolts. However, a person or one of ordinary skill in the art will appreciate that any other known mechanism for coupling can also be used. Further, the spring slide assembly 500 may include a shaft 510 that passes through the gearbox mount part 502 and the carriage mount part 504. As shown, the shaft 510 may be fitted with springs 512*a* and 512*b* at each end and retained by spring retainers 514*a* and 514*b* respectively.

As shown in FIG. 5B, the spring slide assembly 500 may further include retaining rings 516*a-b* to lock the shaft 510 onto the carriage mount part 504. Therefore, the gearbox mount part 502 may slide over the shaft 510 with respect to the carriage mount part 504. During the drilling operation, the spring slide assembly 500 may enable the gearbox assembly 112 in FIG. 1 to slide over or move independently of the carriage assembly 110 in FIG. 1 along the shaft 510. The motion of the carriage assembly 110 in FIG. 1 may compress or stretch the springs 512*a-b*. For example, during a forward motion of the carriage assembly 110 in FIG. 1, the spring 512*b* can be compressed and the spring 512*a* can be stretched. Therefore, when a spring 512*a* or 512*b* is fully compressed, for example in either forward or backward direction, inside edges of gearbox mount part 502 and a carriage mount part 504 can contact each other. For example, as shown, during a forward motion, an inside edge 518 of the gearbox mount 502 can contact the inside edge 520 of the carriage mount 504 and the full thrust force of the carriage assembly 110 in FIG. 1 is transferred to the gearbox assembly 112 in FIG. 1. Further, the spring slide assembly 500 may include lubrication ports 522*a-b* to supply lubricants, such as, but not limited to, grease to the sliding parts. The lubrication may enable smooth sliding and reduces wear and tear of the sliding parts. Therefore, the sliding mechanism of the spring sliding assembly 500 may enable transmission of thrust from the carriage assembly 110 in FIG. 1 to the gearbox assembly 112 in FIG. 1 without excessive loading during the threading or unthreading of the drill pipes during the drilling operation. Further, the spring sliding assembly 500 may enable an easy replacement of the components or the whole spring slide assembly 500 from the drill 100 shown in FIG. 1.

As discussed above, the drill 100 may provide several advantages over the conventional drills. The drill 100 may be attached to any external hydraulic arm and may also be folded or collapsed. In a preferred embodiment of the present invention, the external hydraulic arm is that of a backhoe and may be easily transported to tight areas and smaller job sites. Further, the drill 100 may be placed to operated both towards and away from a user. In yet another embodiment of the present invention, the drill 100 can comprise an hydraulic jack assembly to adjust the height of the drill 100 for a desired angle and direction of drilling. In embodiments of the present invention, various components of the drill 100 are modular such that they may be easily attached, detached, or replaced to provide a longer serviceable life.

In a preferred embodiment of the present invention, the drill 100 will be powered by any external hydraulic power source. In an embodiment of the present invention, the external hydraulic power source may comprise a hydraulic excavator arm of a backhoe. More specifically, the external hydraulic power source may be attachably detached to the drill 100.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to a drill. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, systems and/or apparatus substantially as depicted and described herein, including various embodiments, sub-combinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A drill for drilling a drill pipe into a surface, comprising:

a body;

a track assembly mounted on the body;

a carriage assembly slidably mounted on the track assembly, wherein the carriage assembly is configured to move the drill pipe along the track assembly;

a gearbox assembly coupled to the carriage assembly, wherein the gearbox assembly is configured to rotate the drill pipe;

a pair of spring slide assemblies configured to couple the carriage assembly and the gearbox assembly; and a hydraulic jack assembly coupled to a first end of the body, wherein the hydraulic jack assembly is configured to adjust a height and an angle of the drill.

2. The drill of claim 1, wherein the body comprises:

a frame; and an attachment bracket coupled to the frame, wherein the attachment bracket is configured to attach the drill to an external hydraulic device.

3. The drill of claim 2, wherein the external hydraulic device is a backhoe bucket hydraulic cylinder.

4. The drill of claim 1, wherein the track assembly comprises:

a guide rail; and a track plate.

5. The drill of claim 1, wherein the carriage assembly comprises:

a thrust drive gear;

a hydraulic thrust motor coupled to the thrust drive gear; and a track roller.

6. The drill of claim 5, wherein the thrust drive gear engages the track assembly.

7. The drill of claim 5, wherein the track roller engages the track assembly.

8. The drill of claim 1, wherein the gearbox assembly comprises:

a spindle configured to rotate the drill pipe;

a drive gear coupled to the spindle, wherein the drive gear is configured to rotate the spindle; and a hydraulic drive motor coupled to the drive gear, wherein the hydraulic drive motor is configured to actuate the drive gear.

9. The drill of claim 1, wherein each of the pair of spring slide assemblies comprises:

a carriage mount coupled to the carriage assembly;

a gearbox mount coupled to the gearbox assembly; and a shaft passing through the carriage mount and gearbox mount, wherein the shaft comprises a spring mechanism at each end of the shaft, and wherein the gearbox mount is configured to slide along the shaft with respect to the carriage mount.

10. A drill for drilling a drill pipe into a surface, comprising:

a body;

a hydraulic jack assembly coupled to a first end of the body, wherein the hydraulic jack assembly is configured to adjust a height and an angle of the drill;

a track assembly mounted on top of the body, wherein the track assembly comprises;

a guide rail; and a track plate;

a carriage assembly slidably mounted on the track assembly, wherein the carriage assembly is configured to move the drill pipe along the track assembly; and a gearbox assembly coupled to the carriage assembly by a pair of spring slide assemblies, wherein the gearbox assembly is configured to rotate the drill pipe.

11. The drill of claim 10, wherein the hydraulic jack assembly comprises:

a telescopic leg configured to adjust a height of the drill;

a hydraulic arm configured to actuate the telescopic leg; and a support foot, wherein the telescopic leg is hingeably coupled to the support foot.

12. The drill of claim 10, wherein the carriage assembly comprises:

a thrust drive gear to engage the track plate;

a hydraulic thrust motor coupled to the thrust drive gear;

a track roller to engage with the track plate; and a first edge track roller and a second edge track roller, wherein the first track roller is configured to capture a top surface of the guide rail, and the second edge track roller is configured to capture a bottom surface of the guide rail.

13. The drill of claim 10, further comprising:

a spring slide assembly comprising:

a carriage mount coupled to the carriage assembly;

a gearbox mount coupled to the gearbox assembly; and a shaft passing through the carriage mount and gearbox mount, wherein the shaft comprises a spring mechanism at each end of the shaft, and wherein the gearbox mount is configured to slide along the shaft with respect to the carriage mount.

14. The drill of claim 10, wherein the body comprises:

a hydraulic wrench assembly coupled to an end of the body opposite the hydraulic jack assembly:

a mud pump;

a hydraulic motor configured to actuate the mud pump;

a hydraulic control valve;

a hose raceway; and a hydraulic control joystick.

* * * * *